US005332474A

United States Patent [19]

Maxham

[11] Patent Number: 5,332,474

[45] Date of Patent: Jul. 26, 1994

[54] CONVERSION OF PULP AND PAPER MILL WASTE SOLIDS TO A PAPERMAKING FILLER PRODUCT

[76] Inventor: John V. Maxham, 65 S. Meadows Dr., Appleton, Wis. 54915

[21] Appl. No.: 4,841

[22] Filed: Jan. 19, 1993

[51] Int. Cl.[5] ..... D21C 5/02

[52] U.S. Cl. ..... 162/189; 162/7; 162/6; 162/55; 162/DIG. 9

[58] Field of Search ..... 162/189, 190, 6, 7, 162/78, 55, DIG. 9

[56] References Cited

U.S. PATENT DOCUMENTS

| | | | |
|---|---|---|---|
| 3,220,546 | 11/1965 | Gardner . | |
| 3,833,468 | 9/1974 | Boniface | 162/264 |
| 3,876,497 | 4/1975 | Hoffman | 162/189 |
| 3,897,301 | 7/1975 | Bauman et al. | 162/87 |
| 4,390,395 | 6/1983 | De Ceusler et al. | 162/6 |
| 4,983,258 | 1/1991 | Maxham | 162/189 |
| 5,002,633 | 3/1991 | Maxham | 162/5 |
| 5,137,599 | 8/1992 | Maxham | 162/5 |

*Primary Examiner*—W. Gary Jones
*Assistant Examiner*—Dean T. Nguyen
*Attorney, Agent, or Firm*—Andrus, Sceales, Starke & Sawall

[57] ABSTRACT

A process for the production of a papermaking filler product from the fiber fines/clay fraction of a pulp, paper, paperboard, or deinking mill waste solids such process comprising the reaction of said solids with sufficient acid to lower and maintain a pH of less than 5.0. Such process yields improvement in the drainage characteristics of the material. Bleach can be added or the pH raised back to neutral to further improve the specific resistance and/or brightness of the material.

11 Claims, No Drawings

CONVERSION OF PULP AND PAPER MILL WASTE SOLIDS TO A PAPERMAKING FILLER PRODUCT

1. Field of the invention

This invention relates to a process conveting the fiber fines/clay fraction of pulp, paper, paperboard and/or deinking (secondary fiber) mill waste solids (commonly referred to as sludge) into a product useful as a filler in the production of paper or paperboard.

2. Prior Art

The manufacture of paper or paperboard products involves the blending of fibrous (pulp) and non-fibrous (filler) materials with water and other chemicals (additives) and running the resultant furnish on a machine to form the desired sheet of board. The fibrous or pulp portion is most often derived from wood consisting of cellulose, lignin, hemicellulose and other more minor components. Wood pulp subjected to a severe chemical pulping process (e.g. Kraft and sulfite) will consist mainly of cellulose fiber whereas wood subject to strictly mechanical processing with have fiber of essentially the same composition as the original wood minus the water soluble extractives. There are semi-chemical or semi-mechanical pulping processes yielding pulps with properties somewhere between that of chemical and ground-wood pulps.

The two main classes of wood are softwood and hardwood. Pulp produced from softwood contains predominantly long fiber and has little material that passes a 200 mesh screen (known as short fiber or fiber fines). Hardwood pulp has a much shorter fiber length on the average than softwood pulp and contains appreciable fiber fines. The filler portion of a papermaking furnish most often consists of inorganic fine particle materials with an average particle size normally less than two microns. These materials are most often kaolin clays, calcium carbonate and titanium dioxide. Important properties of fillers include brightness and refractive index. Chemical additives to the furnish include biocides, chelating agents, defoamers, dry and wet strength agents, dyes, retention aids, and sizing.

In the manufacture of paper or board, nearly all mills employ devices called savealls which serve to save as much of the furnish components as possible. It is inevitable, however, that a portion of the solids escape the machine area and are discharged to the mill sewer. From there the waste solids proceed to the wastewater treatment facility. There the settleable solids are normally removed in a gravity sedimentation basin called the primary clarifier (a dissolved air flotation system is also used in some instances). The primary clarifier effluent is often given secondary treatment in a biological process to remove predominantly the soluble organic materials called BOD. The sludges produced in primary and secondary treatment are then normally combined and dewatered on a belt press, centrifuge, screw press, vacuum filter or other dewatering device. Organic and/or inorganic polymers are normally used to assist dewatering.

On the average, about 6% of the paper mill's production will be discharged from the mill as waste solids. For example, an average pulp and paper mill producing 1000 tons per day of paper or board is expected to generate about 60 tons per day of oven dry (OD) waste solids. The actual quantity of waste solids generated by a pulp and paper mill depends to a large extent on the, type of mill. A mill using primarily waste paper as a raw material (called a deinking mill) will have losses well above the 6% average. Losses of 20 to 30% would not be uncommon for such a mill. A non-integrated, non-coated fine paper mill using primarily softwood virgin market pulps in the furnish will have losses well below 1%.

Nearly all mills try to conserve the long fiber fraction of the waste solids that may otherwise be sewered. Equipment such as savealls are installed at the mill for the purpose of long fiber recovery. Also, some mills pump the underflow from the primary clarifier at the wastewater treatment plant (normally 1 to 5% consistency) directly back to the mill to be blended with other furnish components. This practice is acceptable for paperboard and unbleached fiber mills that make a product not requiring a high degree of brightness, cleanliness, or strength. This practice would not be acceptable for a fine paper mill. This type of mill could practice the art of long fiber recovery as taught by Maxham (U.S. Pat. Nos. 4,983,258, 5,002,633 and 5,137,599), Boniface (U.S. Pat. No. 3,833,468) or Gardner (U.S. Pat. No. 3,220,546) either from waste solids contained in the mill sewer, from the primary clarifier underflow, or from the dewatered sludge from the pulp and paper mill. In these patents, it is taught that the recovered long fiber can be subjected to various cleaning, screening and bleaching steps to make it more acceptable for fine papermaking.

Most furnish conservation efforts focus on the recovery of the long fiber fraction of the waste solids with little or no attention being focused on the fiber fines and clay. Nevertheless, the fiber fines/clay fraction normally constitutes the majority of waste solids being disposed of by pulp and paper mills, particularly from deinking mills and other mills having excellent long fiber recovery systems. The Hoffman patent (U.S. Pat. No. 3,876,497) describes a process where the wet air oxidation process is used to thermally destroy the fiber fines fraction thereby recovering a clay fraction as a filler product. Unfortunately, it is well known to those in the pulp and paper industry that very few wet air oxidation units have been installed on a commercial basis due principally to the very high capital and operation and maintenance costs of the system. Furthermore, the recovered clay may not meet the brightness and other specifications desired by the mill for a filler product.

The main problems associated with recycling the fiber fines/clay fraction directly to papermaking operations is the fact that the material may have a low brightness and may cause the furnish to drain too slowly on a paper machine. A slow furnish drainage time is detrimental as the paper machine wire speed must be reduced to adequately drain the water from the furnish. This in turn lowers the production capacity of the paper machine.

STATEMENT OF THE INVENTION

1. Measuring Brightness and Specific Resistance of Fiber Fines/Clay Suspensions Measuring fiber fines/clay solids brightness according to TAPPI Standard Test Method T646 om-86 is problematic for many samples. One requirement of the test method is t dry the sample and pulverize it to a fine powder. This is very difficult to do with fiber fines/clay suspensions that often harden into a cement like substance after oven drying. Therefore, a simple and reproducible analytical method is needed to measure brightness. Also a simple and reproducible analytical method is needed to measure the effect of the fiber fines/clay materials on the drainage characteristics of a typical papermaking furnish. TAPPI Test Method T221 om-88 could be used where the time needed to form a standard 1.2 g handsheet in a standard handsheet mold would be measured. In this procedure, it would be necessary to specify a standard papermaking furnish of softwood and hardwood virgin fibers plus fiber fines/clay material. Performing this test on a routine basis would be very time consuming.

A method has been devised where the drainage characteristics of fiber fines/clay suspensions can be measured while forming a plaque suitable for the brightness measurement. This method is now described:

Thirty grams (30 g) of a 3% consistency slurry is filtered through a Gooch crucible containing a glass microfiber filter (Whatman 934-AH, 3.7 cm). The time needed to filter the slurry under vacuum (20–24 in Hg) is recorded. Two methods of recording time can be practiced. One method (method 1) is to record the time needed to collect 10, 15, and 20 ml respectively of filtrate. In this method, a graduated cylinder is placed within the filter flask beneath the crucible holder. An alternative method (method 2) is to record the time needed to completely filter and dewater the 30 gram sample. Afterwards, the filter pad is removed from the crucible and pressed on the filtrate solids side with a wide blade spatula to produce a smooth and shiny surface with no cracks. The smooth and shiny surface is then placed on top of the opening on a standard brightness meter. After recording the brightness measurement, the pad is rotated approximately 90 degrees and another measurement taken. This is repeated until a total of four or five measurements are taken.

Drainage time measurements in this procedure can be converted to filter cake specific resistance values by use of the following formula derived from the well known Darcy's equation for flow in porous media:

$$R=(2bPA^2)/uc \quad (1)$$

where:

R—specific resistance of the cake (m/kg)
b—slope of t/V versus V ($s/m^6$)
A—area of filter ($m^2$)
V—volume of filtrate collected ($m^3$)
t—time from start of test (s)
c—mass of solids per unit volume of filtrate ($kg/m^3$)

The specific resistance is usually of the order of magnitude of $10^{12}$ m/kg and is abbreviated as Tm/kg. The brightness measurement made on the moist filter pad is lower than that performed using TAPPI Standard Test Method T646 om-86. A series of tests were performed where samples of fiber fines/clay and other materials had the brightness measured by both TAPPI Standard Test Method T646 om-86 and the procedure described above. A total of twenty-three samples were measured in this fashion. The data were correlated using a least squares power function as follows:

$$SB=7.4917\ NSB^{0.5783} \quad (2)$$

$$r=0.9636$$

where:

SB—TAPPI standard brightness measurement (%)
NSB—non-standard brightness measurement (%)
r—correlation coefficient 2. Effect of Fiber Fines/Clay on Papermaking Furnish Drainage Characteristics Experiments were performed to determine the effect of fiber fines/clay on papermaking furnish drainage characteristics. A pulp sample derived from 100% post-consumer white office waste was collected on 03/16/92 from the Prime Fiber Corporation Appleton Pulp mill that had a freeness of 600. Portions of this sample were refined in a Valley beater to freeness levels of 420 and 190. The 190, 420, and 600 freeness pulps were then mixed with fiber fines/clay composite samples (also from 100% post-consumer white office wastepaper) obtained from a Black Clawson double nip thickener (DNT) also located at the Prime Fiber Corporation Appleton pulp mill and the specific resistance measured. The Black-Clawson DNT separates the long fiber pulp fraction from the fiber fines/clay fraction (which may also include very fine ink particles and other very fine debris) using an endless approximately 100 mesh wire cloth. On the average, about 94% of the DNT filtrate solids passed through a 325 mesh screen in a Bauer-McNett apparatus even though the wire cloth on the DNT was only approximately 100 mesh. The results are presented in Table 1. It is seen that specific resistance is a very strong function of the percentage of DNT solids in the furnish. This is evidence proving that the percentage of fiber fines contained in a papermaking furnish is a major factor (and probably the predominant factor) determining the drainage characteristics of a papermaking furnish.

The data are correlated very well if it is assumed that the specific resistance is an exponential function of % DNT solids contained in the furnish according to the following equation:

$$R=B*e^{(m*\%DNT)} \quad (3)$$

where:

R—specific resistance of the cake (Tm/kg)
B—a constant
m—a constant (slope of ln R versus %DNT curve)
%DNT - % of DNT fiber fine/clay solids by weight in the furnish
r—correlation coefficient Table 2 gives the values of the constants, B and m, in equation 3 and the correlation coefficient, r, for the pulp and DNT composite samples. In all cases, the correlation coefficient was greater than 0.99. Table 3 presents drainage times of the pulp and DNT filtrate solids mixtures performed according to TAPPI test method T221 om-88 except that the drainage time of pure water in the British standard sheet mold used was 10.2 sec instead of 4 sec as specified in the standard methed. This would create erroneous results if the drainage time of a furnish were close to 10 seconds. During the test procedure, the concentration of the solids in the sheet mold were the same causing the handsheet weight to vary. This would also be a deviation from the standard method that specifies a constant handsheet weight of 1.2 g.

The data given in Table 3 show that the amount of DNT solids present in a furnish dramatically influences drainage time. At high %DNT solids levels, a significant quantity of solids pass through the sheet mold screen causing the sheet weight to be low and the drainage time to be lower than expected if the standard procedure were followed. Nevertheless, the drainage time appears to be approximately an exponential function of the %DNT solids contained in the furnish. The values of the slope m would be the same order of magnitude as those given in table 2 where the specific resistance was measured instead of drainage time. Based on this work, it was felt that the specific resistance measurement adequately characterized the effect of fiber fines/clay mixtures on the drainage characterized the effect of fiber furnishes and was used in lieu of measuring drainage times of a British standard sheet mold.

TABLE 1

Specific Resistance of Pulp and DNT Solids Mixtures

| Pulp CSF | DNT Sample # | % DNT Solids | Specific Resistance (Tm/kg) |
|---|---|---|---|
| 600 | 10–12 Composite | 0 | 0.00245 |
| | | 25 | 0.0188 |
| | | 50 | 0.166 |
| | | 65 | 0.500 |
| | | 75 | 1.59 |
| | | 85 | 1.76 |
| | | 100 | 5.41 |
| 420 | 10–14 Composite | 0 | 0.0307 |
| | | 15 | 0.0433 |
| | | 35 | 0.106 |
| | | 50 | 0.307 |
| | | 75 | 0.987 |
| | | 100 | 4.32 |
| 190 | 10–14 Composite | 0 | 0.0794 |
| | | 15 | 0.105 |
| | | 35 | 0.249 |
| | | 50 | 0.420 |
| | | 75 | 1.25 |
| | | 100 | 3.95 |

TABLE 2

Calculated Values of Constants in the Equation $R\ (Tm/kg) = B*e^{(m*\%DNT)}$

| Pulp CSF | DNT Sample # | B | m | r |
|---|---|---|---|---|
| 600 | 10–12 Composite | 0.02824 | 0.07833 | 0.9957 |
| 420 | 10–14 Composite | 0.02317 | 0.05088 | 0.9948 |
| 190 | 10–14 Composite | 0.06475 | 0.03991 | 0.9960 |

TABLE 3

Raw Drainage Times of PFC Pulp and DNT Solids Mixtures in a British Standard Sheet Mold

| Pulp CSF | DNT Sample # | % DNT Solids | Drainage Time (sec) | Sheet Weight (g) |
|---|---|---|---|---|
| 420 | 10–14 Composite | 0 | 11.3 | 1.21 |
| | | 15 | 12.0 | 1.12 |
| | | 35 | 17.8 | 1.02 |
| | | 50 | 50.5 | 0.95 |
| | | 75 | 220.7 | 0.81 |
| | | 100 | 282.7 | 0.50 |
| 190 | 10–14 Composite | 0 | 21.3 | 1.21 |
| | | 15 | 35.3 | 1.17 |
| | | 35 | 72.6 | 1.06 |
| | | 50 | 152.1 | 1.01 |
| | | 75 | 393.0 | 0.85 |
| | | 100 | 282.7 | 0.50 |

Note: The drainage time of pure water was 10.2 sec instead of 4 sec and sheet weight was often less than 1.2 g as specified in TAPPI Standard Method T221 om-88.

3. Improving the Brightness and Specific Resistance of Fiber Fines/Clay Suspensions The value of the fiber fines/clay fraction as a papermaking filler is directly related to its brightness and specific resistance. Bauman and Lutz (U.S. Pat. No. 3,897,301) address the issue of improving fiber fines/clay drainage characteristics by dewatering the solids to a water content of about 5% to 25% solids and then reacting the solids at ambient temperature from about 4 hours to about 72 hours with enough active chlorine bearing chemical to provide about 10 to 50 g per pound of solids (2.2 to 11.0 %). Sodium hypochlorite was the preferred chlorine bearing chemical. Baumann and Lutz claim that this procedure improves drainage characteristics of the fiber fines/clay fraction when substituted for virgin hardwood fiber and clay in a papermaking furnish. Presumedly the brightness of the fiber fines/clay was also improved though Baumann and Lutz did not claim this as a benefit of treatment with an active chlorine bearing chemical.

An extensive series of bleaching experiments were performed on fiber fine/clay samples as generated by the Black Clawson Double Nip Thickener (DNT) at the Prime Fiber Corporation Appleton pulp mill where paper mill sludge was the raw material. The purpose of the experiments was to determine the conditions (e.g. pH, temperature, and bleach dosage) that may improve fiber fines/clay solids brightness and specific resistance. Brightness and specific resistance are the key parameters in determining the suitability of the fiber fines/clay solids as a papermaking filler material. The goal of these experiments was to produce a fiber fines/clay filler product of high brightness that yields acceptable paper machine drainage rates when used as a substitute for virgin papermaking clay and hardwood fiber.

A series of experiments were performed where a 3% fiber fine/clay slurry of DNT solids was defibered with a British disintegrator for 7,500 revolutions at room temperature. A 60 g sample was then put in a 100 ml beaker and placed on a magnetic stirrer/hot plate with no heating. The pH was adjusted to the desired level (3, 5, 7, 9, or 11) and the desired level of sodium hypochlorite (5, 10, 15, 20, 25, or 30%) was added. After mixing for 15 minutes, 30 g of sample was withdrawn into a small bottle and let sit at room temperature for about 24 hours. The brightness and specific resistance test was then performed.

Table 4 presents the results obtained during a particular experiment. Brightness was a linear function of % hypo added in the range of 0–15% hypochlorite. Within this range, brightness increased by 1.55 points for every % hypochlorite added. The correlation coefficient of the least squares line was 0.965. Brightness increased with hypochlorite addition above a dosage of 15% but with a constantly decreasing slope. Close examination of the data in the table shows that brightness was not significantly affected by reaction pH.

The specific resistance was, however, significantly influenced by the reaction pH and increased in a linear fashion as reaction pH increased and was not affected by the dosage level of hypochlorite. The correlation coefficient of the least squares linear regression line was 0.90. Many other similar experiments were performed where the pH and hypochlorite dosage were varied. Though there was often considerable scatter to the data, there was little question that specific resistance was a strong function of reaction pH and was not affected by the dosage of hypochlorite in the range of 5 to 30%. Those data were correlated by a least squares linear regression model as follows:

$$R = m*pH + B$$

where:

R—specific resistance of the cake (Tm/kg)

B—a constant m—a constant (slope of R versus pH curve)

r—correlation coefficient

Values of the constants B and m and correlation coefficients are given in Table 5 for nine experiments that were performed in an identical manner. Through the brightness would often increase with hypochlorite dosage in a linear fashion up to 15%, this was true only for samples containing bleachable dyes as the cause of low brightness. In the case where the low brightness was due to very fine ink particles, the hypochlorite addition would be ineffective in increasing brightness.

TABLE 4

DNT FILTRATE SOLIDS BLEACH EXPERIMENT 3
DNT Sample #1 (04/25/91)

| Hypochlorite Conc. | Reaction Time (hrs) | Brightness | Specific Resistance (Tm/kg) | pH | Temp (°C.) |
|---|---|---|---|---|---|
| Control | | 43.1 | 3.16 | 6.06 | RT |
| 5% | 24 | 50.3 | 1.75 | 2.12 | " |
| 10% | " | 59.0 | 1.90 | 3.58 | " |
| 15% | " | 70.1 | 1.55 | 3.36 | " |
| 20% | " | 72.2 | 1.88 | 3.22 | " |
| 25% | " | 70.6 | 1.26 | 3.20 | " |
| 30% | " | 72.0 | 1.69 | 3.45 | " |
| 5% | 24 | 50.2 | 2.03 | 4.17 | RT |
| 10% | " | 61.8 | 2.05 | 5.21 | " |
| 15% | " | 68.9 | 1.99 | 5.60 | " |
| 20% | " | 71.5 | 2.45 | 4.89 | " |
| 25% | " | 71.3 | 2.42 | 5.27 | " |
| 30% | " | 73.7 | 2.16 | 5.04 | " |
| 5% | 24 | 54.1 | 2.88 | 6.11 | RT |
| 10% | " | 59.2 | 3.04 | 6.60 | " |
| 15% | " | 68.7 | 3.35 | 6.16 | " |
| 20% | " | 71.3 | 2.86 | 5.93 | " |
| 25% | " | 73.2 | 2.55 | 5.95 | " |
| 30% | " | 74.8 | 2.34 | 5.68 | " |
| 5% | 24 | 55.7 | 3.08 | 7.06 | RT |
| 10% | " | 60.3 | 3.41 | 6.64 | " |
| 15% | " | 66.0 | 3.30 | 7.07 | " |
| 20% | " | 71.5 | 3.54 | 6.58 | " |
| 25% | " | 73.0 | 2.89 | 6.25 | " |
| 30% | " | 72.2 | 2.78 | 6.27 | " |
| 5% | 24 | 56.4 | 4.04 | 9.79 | RT |
| 10% | " | 62.2 | 3.94 | 9.01 | " |
| 15% | " | 66.5 | 4.17 | 9.01 | " |
| 20% | " | 69.5 | 3.01 | 8.26 | " |
| 25% | " | 73.6 | 2.93 | 8.05 | " |
| 30% | " | 73.0 | 2.91 | 8.24 | " |

TABLE 5

Calculated Values of Constants in the Equation
R (Tm/kg) = m*pH + B

| Experiment No. | DNT Sample # | B | m | r |
|---|---|---|---|---|
| 1 | 1 | −3.64 | 1.37 | 0.81 |
| 3 | 1 | 0.58 | 0.35 | 0.90 |
| 4 | 3 | 0.12 | 0.70 | 0.73 |
| 5 | 4 | 0.51 | 0.58 | 0.79 |
| 7 | 5 | 5.36 | 1.50 | 0.81 |
| 9 | 6 | 1.22 | 0.53 | 0.87 |
| 11 | 7 | −0.72 | 0.59 | 0.59 |
| 13 | 8 | 0.35 | 1.13 | 0.84 |
| 18 | 9 | 0.19 | 0.17 | 0.75 |

To verify the effect of pH on the specific resistance a series of experiments were performed where a 3% fiber fine/clay slurry of DNT solids was defibered with a British disintegrator for 7,500 revolutions at room temperature. A total of five 60 g aliquots were metered out into 100 ml beakers. The aliquots were then adjusted to pH 3, 5, 7, 9, and 11 with either NaOH or $H_2SO_4$. Sodium hypochlorite bleach was then added at the level of 15 wt % based on OD remnant sludge solids. As soon as the bleach was stirred in well (about 2 or 3 minutes), the pH was adjusted to the desired pH level. The pH was then monitored and adjusted for the next hour then let sit for 24 hours. After 24 hours, the pH was adjusted to the desired pH level and the specific resistance test performed. The results are presented in Table 6.

In this experiment a major effort was made to keep the pH at a constant level throughout the 24 hour reaction period. Addition of sodium hypochlorite to a sample will raise the pH into the alkaline region. The brightness after reaction at the different pH levels was about the same for all samples. The specific resistance was a strong function of reaction pH. An exponential least squares curve fit had a correlation coefficient of 0.963.

The pH of the DNT filtrate solids had a very significant influence on its specific resistance. In experiments where the DNT filtrate solids were reacted with 15% hypochlorite at room temperature for 24 hours at the pH levels of 3, 5, 7, 9, and 11, the data were well correlated by the following exponential equation:

$$R = B*e^{(m*pH)}$$

where:

R—specific resistance of the cake (Tm/kg)

B—a constant m—a constant (slope of in R versus pH curve)

r—correlation coefficient

Values of the constants B and m are given in Table 7 for five experiments that were performed in an identical manner.

TABLE 6

DNT FILTRATE SOLIDS BLEACH EXPERIMENT 22
DNT Sample #3 (04/06/92)

| Hypochlorite Conc. | Reaction Time (hrs) | Brightness | Specific Resistance (Tm/kg) | pH | Temp (°C.) |
|---|---|---|---|---|---|
| 15% | 24 | 54.9 | 1.35 | 3.01 | RT |
| " | " | 54.5 | 3.00 | 5.02 | " |
| " | " | 53.8 | 3.25 | 7.13 | " |
| " | " | 55.8 | 15.51 | 8.98 | " |
| " | " | 55.9 | 27.06 | 11.09 | " |

TABLE 7

Calculated Values of Constants in the Equation
R (Tm/kg) = $B*e^{(m*pH)}$

| Experiment No. | DNT Sample # | B | m | r |
|---|---|---|---|---|
| 22 | 3 | 0.391 | 0.378 | 0.963 |
| 23 | 4 | 0.685 | 0.306 | 0.951 |
| 24 | 5 | 0.328 | 0.297 | 0.956 |
| 25 | 6 | 1.887 | 0.130 | 0.874 |
| 17 | 7 | 0.402 | 0.207 | 0.997 |

To further investigate the effect of pH on specific resistance several experiments were performed where a 3% fiber fine/clay slurry of DNT solids was defibered with a British disintegrator for 7,500 revolutions at room temperature. Two 200 ml portions of the slurry were put in beakers. The aliquots were then adjusted to pH 3 or 11 with either NaOH or $H_2SO_4$ and allowed to stir at room temperature for one hour. The pH was monitored during this time period and adjusted as necessary to reach the target pH. After one hour, the slurries were simply left standing at room temperature without stirring for 24 hours. After 24 hours the pH of the samples were measured and portions taken to measure brightness and specific resistance. The pH was then adjusted to a different value and the procedure described above repeated. The experiment ended at 168 hours. The results are presented in Table 8.

The purpose of this experiment was to examine the effect of pH per se on the brightness and specific resistance of DNT filtrate solids. As expected, there was little impact of pH of brightness. However, pH had a profound influence on specific resistance. The specific resistance at pH of 3 was significantly less than at pH of 11.

Successive raising and lowering the pH seemed to cause the pH 3 specific resistance values to climb with time; conversely the pH 11 values decreased with time.

TABLE 8

DNT FILTRATE SOLIDS BLEACH EXPERIMENT 32
DNT sample #4 (09/01/92)

| Hypochlorite Conc. | Reaction Time (hrs) | Bright-ness | Specific Resistance (Tm/kg) | pH | Temp (°C.) |
|---|---|---|---|---|---|
| 0 | 24 | 38.7 | 1.52 | 3.10 | RT |
| " | 48 | 37.2 | 42.21 | 10.41 | " |
| " | 72 | 38.4 | 3.12 | 3.07 | " |
| " | 96 | 37.4 | 31.75 | 10.16 | " |
| " | 168 | 39.7 | 3.72 | 2.92 | " |
| 0 | 24 | 39.5 | 43.65 | 10.20 | RT |
| " | 48 | 38.4 | 1.44 | 3.21 | " |
| " | 72 | 39.0 | 26.61 | 10.19 | " |
| " | 96 | 38.8 | 2.67 | 3.00 | " |
| " | 168 | 38.2 | 10.10 | 10.14 | " |
| Raw sample previously measured | | 37.8 | 4.23 | — | " |

To further verify the effect of pH on specific resistance a 3% fiber fine/clay slurry of DNT solids was defibered with a British disintegrator for 7,500 revolutions at room temperature. The pH of the slurry was taken and the specific resistance test performed. The pH was then lowered to 3.0 and the specific resistance test performed immediately and again at 1, 2, 3, 24, 48, 72, 96, and 168 hours. The pH was readjusted to 3.0 after 1 hour but thereafter no further pH adjustments were made. A portion of the pH 3 slurry was taken after 24 hours and adjusted to pH 7 with NaOH. The specific resistance test was performed immediately and again at 1, 2, 3, and 24 hours. The pH was readjusted to 7.0 after 1 hour but thereafter no further pH adjustments were made. Other portions of the pH 3 slurry were taken after 24 hours and had 1% of either sodium hydrosulfite or sodium hypochlorite bleach added . The specific resistance test was performed immediately and again at 24, 48, 72, and 144 hours. The results are presented in Table 9.

The purpose of this experiment was to examine the effect of pH and modest dosages of bleach on the brightness and specific resistance of DNT filtrate solids. As expected, there was little or no impact of pH or bleach dosage on brightness due to the fact that the low brightness was due to the presence of unbleachable ink particles.

The pH had a significant impact on specific resistance. In the case where no bleach was added, lowering the pH to 3 immediately lowered the specific resistance from 13.42 to 5.97. The specific resistance gradually dropped to 4.77 after one week. Adjusting the pH back to 7 after the DNT solids had been reacted at pH 3 for 24 hours, caused the specific resistance to go from 5.07 to 3.28. This result was surprising. After 24 hours the specific resistance climbed to 4.18. Addition of 1% hydrosulfite or hypochlorite to the slurry that had been reacted at pH 3 for 24 hours further lowered the specific resistance.

TABLE 9

DNT FILTRATE SOLIDS BLEACH EXPERIMENT 34
DNT Sample #19 (10/27/92)

| Bleach Conc. | Reaction Time (hrs) | Bright-ness | Specific Resistance (Tm/kg) | pH | Temp (°C.) |
|---|---|---|---|---|---|
| 0 | 0 | 66.5 | 13.42 | 7.75 | RT |
| " | 0+ | 65.1 | 5.97 | 3.00 | " |
| " | 1 | 65.2 | 5.97 | 3.00 | " |
| " | 2 | 65.8 | 5.97 | 3.07 | " |
| " | 3 | 65.3 | 5.97 | 3.06 | " |
| " | 24 | 65.4 | 5.07 | 3.20 | " |
| " | 48 | 66.2 | 5.07 | 3.26 | " |
| " | 72 | 65.9 | 5.07 | 3.29 | " |
| " | 96 | 65.9 | 4.77 | 3.33 | " |
| " | 168 | 65.6 | 4.77 | 3.35 | " |
| Reacted at pH 3.0 for 24 hours then adjusted to pH 7.0 | | | | | |
| 0 | 0+ | 64.7 | 3.28 | 7.00 | RT |
| " | 1 | 64.8 | 3.88 | 7.04 | " |
| " | 2 | 65.1 | 3.28 | 6.96 | " |
| " | 3 | 65.1 | 4.18 | 6.95 | " |
| " | 24 | 65.6 | 4.18 | 7.22 | " |
| Reacted at pH 3.0 for 24 hours then 1% bleach added | | | | | |
| 1% Hydrosul | 0+ | 65.8 | 3.58 | 3.00 | RT |
| " | 24 | 65.2 | 3.58 | 3.08 | " |
| " | 48 | 65.1 | 4.18 | 3.14 | " |
| " | 72 | 66.3 | 4.18 | 3.15 | " |
| " | 144 | 66.1 | 3.58 | 3.19 | " |
| Reacted at pH 3.0 for 24 hours then 1% bleach added | | | | | |
| 1% Hypochl | 0+ | 65.3 | 3.58 | 3.06 | RT |
| " | 24 | 66.2 | 2.39 | 3.08 | " |
| " | 48 | 66.4 | 2.09 | 3.06 | " |
| " | 72 | 66.9 | 2.09 | 3.02 | " |
| " | 144 | 66.9 | 2.09 | 3.06 | " |
| Raw sample previously measured | | 65.8 | 13.08 | — | " |

To further investigate the effect of pH and reaction time on the drainage characteristics of fiber fines/clay samples produced by a DNT, a 3% slurry of DNT solids was defibered with a British disintegrator for 7,500 revolutions at room temperature. The pH of the slurry was taken and the specific resistance test performed. The pH was then lowered to 3.0 using sulfurnic acid and the specific resistance test performed immediately and against at 1, 2, 3, 24, 48, 72, 96, and 168 hours. The pH was readjusted to 3.0 after 1 hour but thereafter no further pH adjustments were made. A portion of the pH 3 slurry was taken after 24 hours and adjusted to pH 7 with NaOH. The specific resistance test was performed immediately and again at 1, 2, 3, and 24 hours. The pH was readjusted to 7.0 after 1 hour but thereafter no further pH adjustments were made. Other portions of the pH 3 slurry were taken after 24 hours and had 1% of either sodium hydrosulfite or hydrogen peroxide bleach added. The specific resistance test was performed immediately and again at 24, 48, 72, and 144 hours.

Table 10 gives the results of the experiments just described. There was little or no impact of pH or bleach dosage on brightness due to the fact that the low brightness of DNT sample 20 was due to the presence of unbleachable ink particles. The pH had a significant impact on specific resistance. In the case where no bleach was added, lowering the pH to 3 immediately lowered the specific resistance from 4.47 to 2.98. The specific resistance gradually dropped to 1.79 after one week. Adjusting the pH back to 7 after the DNT solids had been reacted at pH 3 for 24 hours, caused the specific resistance to drop from 2.09 to 1.49. A similar result was obtained in the previous experiment. After 24 hours the specific resistance remained at 1.49. Addition of 1% hydrosulfite or peroxide to the slurry that had been reacted at pH 3 for 24 hours did not significantly improve the specific resistance or brightness, unlike in the previous experiment.

TABLE 10

DNT FILTRATE SOLIDS BLEACH EXPERIMENT 35
Sample 20 (10/27/92)

| Bleach Conc. | Reaction Time (hrs) | Brightness | Specific Resistance (Tm/kg) | pH | Temp (°C.) |
|---|---|---|---|---|---|
| 0 | 0 | 67.2 | 4.47 | 7.60 | RT |
| " | 0+ | 66.7 | 2.98 | 3.00 | " |
| " | 1 | 67.1 | 2.98 | 3.00 | " |
| " | 2 | 66.8 | 2.98 | 3.29 | " |
| " | 3 | 66.3 | 2.98 | 3.33 | " |
| " | 24 | 65.5 | 2.09 | 3.51 | " |
| " | 48 | 66.0 | 2.09 | 3.55 | " |
| " | 72 | 67.1 | 1.79 | 3.63 | " |
| " | 96 | 66.7 | 1.79 | 3.64 | " |
| " | 168 | 66.7 | 1.79 | 3.65 | " |
| Reacted at pH 3.0 for 24 hours then adjusted to pH 7.0 | | | | | |
| 0 | 0+ | 65.1 | 1.49 | 7.11 | RT |
| " | 1 | 66.8 | 1.19 | 6.97 | " |
| " | 2 | 66.7 | 1.49 | 6.94 | " |
| " | 3 | 66.3 | 1.49 | 6.99 | " |
| " | 24 | 66.7 | 1.49 | 7.05 | " |
| Reacted at pH 3.0 for 24 hours then 1% bleach added | | | | | |
| 1% Hydrosul | 0+ | 67.0 | 2.09 | 3.05 | RT |
| " | 24 | 66.7 | 2.09 | 3.22 | " |
| " | 48 | 66.9 | 1.79 | 3.26 | " |
| " | 72 | 67.6 | 1.79 | 3.27 | " |
| " | 144 | 67.6 | 1.79 | 3.36 | " |
| Reacted at pH 3.0 for 24 hours then 1% bleach added | | | | | |
| 1% Peroxide | 0+ | 66.3 | 2.39 | 3.04 | RT |
| " | 24 | 66.4 | 1.49 | 3.20 | " |
| " | 48 | 65.7 | 1.79 | 3.22 | " |
| " | 72 | 66.5 | 1.79 | 3.23 | " |
| " | 144 | 66.3 | 1.49 | 3.25 | " |
| Raw sample previously measured | | 66.0 | 1.85 | — | " |

To further investigate the effect of pH and reaction time on the drainage characteristics of fiber fines/clay samples produced by a DNT, a 3% slurry of DNT solids was defibered with a British disintegrator for 7,500 revolutions at room temperature. The pH of the slurry was then lowered to 5.0 and held there for one hour. Afterwards the specific resistance test was performed. This procedure was repeated at a pH of 4 and 3. Table 11 presents the results obtained with DNT samples numbered 15 through 23. In most cases, the specific resistance at pH 4.0 was comparable to the specific resistance at pH 3.0. The specific resistance at pH 5.0 was in many instances comparable to the specific resistance at pH of 3.0 or 4.0 (samples 15, 16, 17, 20, and 22). In other instances, the specific resistance at pH of 5.0 was higher than at pH of 3.0 or 4.0 (samples 18, 19, 21 and 23). In all cases, the specific resistance of the acid treated samples was less than the raw untreated samples.

TABLE 11

DNT FILTRATE SOLIDS BLEACH EXPERIMENT 37
Samples 15-23 (10/30/92)
No Bleach Added

| DNT Sample No. | Reaction Time (hrs) | Brightness | Specific Resistance (Tm/kg) | pH | Temp (°C.) |
|---|---|---|---|---|---|
| 15 | 1 | 53.6 | 3.82 | 5.0 | RT |
| " | 1 | 54.5 | 3.50 | 4.0 | " |

TABLE 11-continued

DNT FILTRATE SOLIDS BLEACH EXPERIMENT 37
Samples 15-23 (10/30/92)
No Bleach Added

| DNT Sample No. | Reaction Time (hrs) | Brightness | Specific Resistance (Tm/kg) | pH | Temp (°C.) |
|---|---|---|---|---|---|
| " | 1 | 54.1 | 3.63 | 3.0 | " |
| Raw sample previously measured | | 56.2 | 5.65 | | |
| 16 | 1 | 58.6 | 2.36 | 5.0 | RT |
| " | 1 | 58.1 | 1.98 | 4.0 | " |
| " | 1 | 59.2 | 2.06 | 3.0 | " |
| Raw sample previously measured | | 58.6 | 2.71 | | |
| 17 | 1 | 60.6 | 2.50 | 5.0 | RT |
| " | 1 | 60.5 | 2.56 | 4.0 | " |
| " | 1 | 61.0 | 2.02 | 3.0 | " |
| Raw sample previously measured | | 64.0 | 4.31 | | |
| 18 | 1 | 55.8 | 3.21 | 5.0 | RT |
| " | 1 | 58.0 | 2.16 | 4.0 | " |
| " | 1 | 65.3 | 1.95 | 3.0 | " |
| Raw sample previously measured | | 57.7 | 3.20 | | |
| 19 | 1 | 65.7 | 4.98 | 5.0 | RT |
| " | 1 | 64.7 | 3.41 | 4.0 | " |
| " | 1 | 59.0 | 3.63 | 3.0 | " |
| Raw sample previously measured | | 65.8 | 13.08 | | |
| 20 | 1 | 67.3 | 1.44 | 5.0 | RT |
| " | 1 | 65.7 | 1.79 | 4.0 | " |
| " | 1 | 66.5 | 1.80 | 3.0 | " |
| Raw sample previously measured | | 66.0 | 1.85 | | |
| 21 | 1 | 63.8 | 3.86 | 5.0 | RT |
| " | 1 | 66.9 | 1.41 | 4.0 | " |
| " | 1 | 68.2 | 1.32 | 3.0 | " |
| Raw sample previously measured | | 66.7 | 6.41 | | |
| 22 | 1 | 66.2 | 1.75 | 5.0 | RT |
| " | 1 | 66.0 | 1.53 | 4.0 | " |
| " | 1 | 65.8 | 1.88 | 3.0 | " |
| Raw sample previously measured | | 67.5 | 2.80 | | |
| 23 | 1 | 62.0 | 2.29 | 5.0 | RT |
| " | 1 | 63.1 | 1.15 | 4.0 | " |
| " | 1 | 63.6 | 1.35 | 3.0 | " |
| Raw sample previously measured | | 65.2 | 3.70 | | |

Various modes of carrying out the present invention are contemplated as being within the scope of the following claims particularly pointing out and distinctly claiming the subject matter which is regarded as the invention.

I claim:

1. A process for improving the drainage characteristics of the fiber fines/clay fraction of waste solids generated by a pulp, paper, paperboard or deinking mill such that it is more suitable as a filler for paper, paperboard, and other fibrous product manufacture. said process comprising the steps of:

a. separating the fiber fines/clay fraction of the waste solids from the other solids;

b. concentrating the fiber fines/clay fraction; and, c. reacting the fiber fines/clay concentrate with sufficient acid to maintain a Ph not more than 5.0 to improve the drainage characteristics of the fiber fines/clay fraction.

2. The process according to claim 1 wherein the pH is maintained in the range of about 3.0 to 5.0.

3. The process according to claim 1 wherein the consistency of the fiber fines/clay concentrate is greater than 3.0% by weight.

4. The process according to claim 1 wherein the temperature is in the range of 20° C. to 90° C.

5. The process according to claim 1 wherein substantially all the fiber fines/clay fraction 5solids are able to pass a 100 mesh screen.

6. The process according to claim 1 wherein bleach is added with the acid to further improve drainage characteristics and to increase brightness.

7. The process according to claim 6 wherein said bleach is selected from the group consisting of hypochlorite, hydrosulfite, and peroxide bleaches.

8. The process according to claim 7 wherein said bleach is added in an amount less than 1% by volume.

9. The process according to claim 1 wherein the pH is raised to a neutral regime after reacting at a Ph of not more 5.

10. The process according to claim 1 wherein said separating step is carried out with a screening device.

11. The process according to claim 1 wherein said concentrating step is carried out with a device selected from the group consisting of sedimentation, flotation, and centrifugal separation equipment.

* * * * *